US005558685A

United States Patent [19]

DeRosa et al.

[11] Patent Number: 5,558,685

[45] Date of Patent: Sep. 24, 1996

[54] NON-METALLIC ANTI-KNOCK FUEL ADDITIVE

[75] Inventors: Thomas F. DeRosa, Passaic, N.J.; William M. Studzinski, Beacon, N.Y.; Joseph M. Russo, Poughkeepsie, N.Y.; Benjamin J. Kaufman, Hopewell Junction, N.Y.; Robert T. Hahn, Beacon, N.Y.

[73] Assignee: Texaco Inc., White Plains, N.Y.

[21] Appl. No.: 308,890

[22] Filed: Sep. 19, 1994

[51] Int. Cl.[6] ..... C10L 1/22

[52] U.S. Cl. ..... 44/426

[58] Field of Search ..... 44/426, 429, 431

[56] References Cited

U.S. PATENT DOCUMENTS

| | | | |
|---|---|---|---|
| 2,009,480 | 6/1932 | Craig | 44/429 |
| 2,230,844 | 2/1941 | Miller et al. | 44/426 |
| 2,662,815 | 12/1953 | Rudel | 44/426 |
| 4,588,417 | 5/1986 | Zaweski et al. | 44/325 |
| 5,312,459 | 5/1994 | Sprugel et al. | 44/334 |

FOREIGN PATENT DOCUMENTS 660527 4/1963 Canada .

*Primary Examiner*—Prince Willis, Jr.
*Assistant Examiner*—Cephia D. Toomer
*Attorney, Agent, or Firm*—Kenneth R. Priem; Richard A. Morgan

[57] ABSTRACT

A gasoline fuel composition comprising a major portion of gasoline and a minor portion of a mixture of dialkyl diphenylamines, effective to increase the octane number of the gasoline composition represented by the formula:

where R and R' independently comprise one or more of butyl, pentyl, hexyl, heptyl and octyl alkyl radicals in any isomeric form is provided.

2 Claims, 1 Drawing Sheet

NON-METALLIC ANTI-KNOCK FUEL ADDITIVE

BACKGROUND OF THE INVENTION

1. Field of the Invention

The present invention relates to a gasoline with improved octane number. More specifically, the present invention relates to a non-metallic anti-knock fuel additive.

2. Description of Related Information

Spark initiated internal combustion gasoline engines require fuel of a minimum octane level which depends upon the design of the engine. If such an engine is operated on a gasoline which has an octane number lower than the minimum requirement for the engine, "knocking" will occur. Generally, "knocking" occurs when a fuel, especially gasoline, spontaneously and prematurely ignites or detonates in an engine prior to spark plug initiated ignition. It may be further characterized as a non-homogeneous production of free radicals that ultimately interfere with a flame wave front. Gasolines can be refined to have sufficiently high octane numbers to run today's high compression engines, but such refining is expensive and energy intensive. To increase the octane level at decreased cost, a number of metallic fuel additives have been developed which, when added to gasoline, increase its octane rating and therefore are effective in controlling engine knock. Although the exact mechanism is unknown, the effectiveness of these metallic agents is believed to entail deactivation of free radical intermediates generated during combustion. The problem with metallic anti-knock gasoline fuel additives, however, is the high toxicity of their combustion products. For example, the thermal decomposition of polyalkyl plumbates, most notably tetramethyl- and tetraethyl lead, are lead and lead oxides. All of these metallic octane improvers have been banned nationwide, because their oxidation products produce metallic lead and a variety of lead oxide salts. Lead and lead oxides are potent neurotoxins and, in the gaseous form of an automotive exhaust, become highly neuro-active.

It would therefore be desirable to identify non-metallic anti-knock agents which would produce little toxic combustion products compared to metallic anti-knock agents, and which would provide a needed increase in octane ratings to eliminate "knocking".

SUMMARY OF THE INVENTION

In accordance with certain of its aspects, the present invention provides a gasoline composition comprising a major portion of a mixture of hydrocarbons boiling in the gasoline boiling range and a minor portion of a dialkyl diphenylamine, effective to increase the octane number of the gasoline composition, represented by the formula:

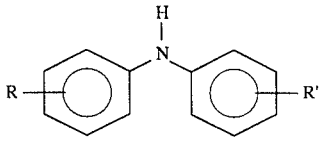

where R and R' comprise an admixture of butyl, pentyl, hexyl, heptyl and octyl alkyl radicals.

In a second embodiment, the present invention provides a method of improving the octane number of a gasoline which comprises adding to a major portion of gasoline, a minor, octane improving portion of the dialkyl diphenylamine described above.

DETAILED DESCRIPTION OF THE INVENTION

Figure 1:
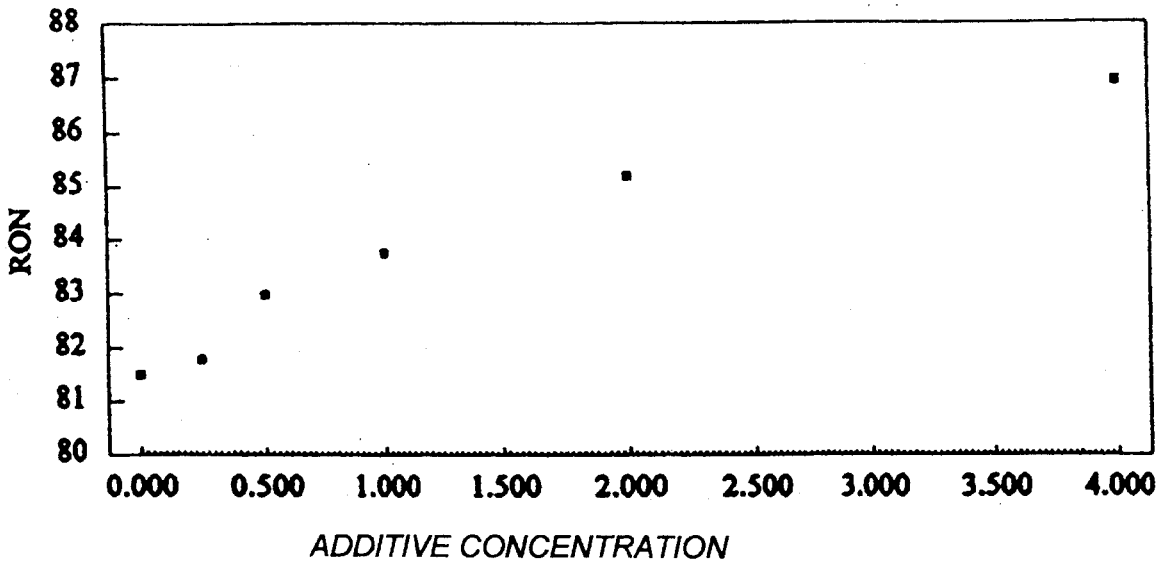
FIGS. 1 and, 2 are graphs which depict the results of a study to determine the concentration effects on octane number for an additive of the invention.

We have found that the anti-knock gasoline fuel additive of the present invention provides significant increases in octane number for gasoline compositions.

The anti-knock gasoline fuel additive of the present invention comprises a mixture of dialkyl diphenylamines represented by the formula:

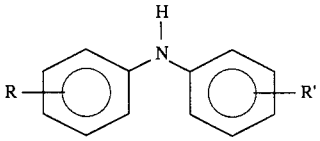

where R and R' independently comprise one or more of butyl, pentyl, hexyl, heptyl and octyl alkyl radicals. Each of these alkyl radicals can be an i- sec-, t-, or n-isomeric form. Furthermore, the mixture can contain these alkyl hydrocarbons in any relative proportions. The orientation of the aliphatic hydrocarbons on the aromatic amine may be ortho, meta, or para with respect to the N bond, and one ring may have the alkyl group orientated in the same or different position as the alkyl group located on the other ring.

The mixtures of dialkyl diphenylamines of the present invention can be prepared in any manner known to those skilled in the art, including:

1) condensing alkyl aniline using an iron catalyst according to the equation:

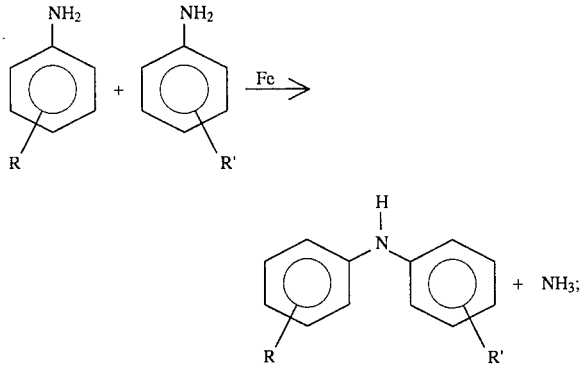

2) reduction of bis-acyl diphenyl amines according to the equation:

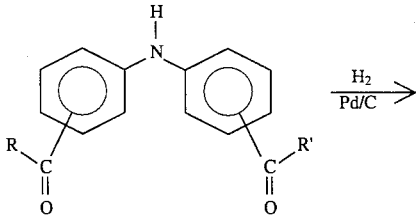

-continued

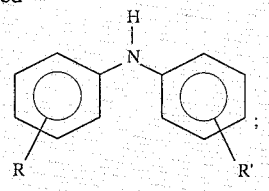

3) direct addition of R and R' to diphenyl amine according to the equation:

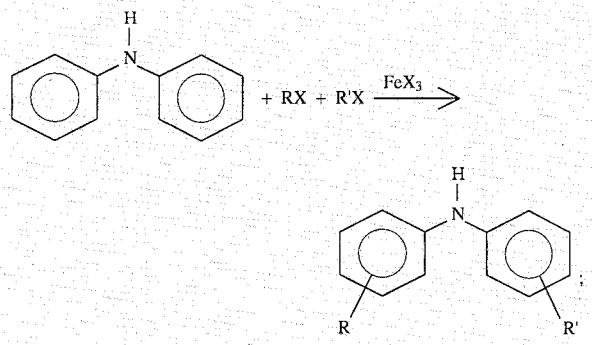

and the like, where R and R' independently comprise one or more of butyl, pentyl, hexyl, heptyl and octyl alkyl radicals. These reactions are well known to those of ordinary skill in the art.

One mixture of dialkyl diphenylamines which can be employed as the anti-knock agent of the present invention is marketed under the name Naugalube 640™, available from Uniroyal, Inc. of Naugatuck, Conn. This dialkyl diphenylamine can be described as containing a Gaussian distribution of all possible isomers, permutations, and structural orientations of $C_4$–$C_8$ alkyl groups.

The anti-knock agent of the present invention is typically employed in a minor octane increasing amount. It may be added in an amount between 0.01 and 50 wt. %, preferably between 0.01 and 5 wt. % and more preferably between about 0.5 and about 2.0 wt. %. The additive can be blended in to the gasoline by any method, because dialkyl phenyl amines show favorable solubility in hydrocarbon solvents.

The gasolines which can be treated by the process of this invention to raise their octane number boil in the range between about 50° F. and about 450° F., and may be straight run gasolines, but more preferably they will be blended gasolines which are available commercially. An example of a typical gasoline useful in the practice of the present invention is provided in Table 1.

TABLE I

| Typical Gasoline | |
|---|---|
| IBP | 80.7° F. |
| 5% | 111.9° F. |
| 10% | 124.5° F. |
| 20% | 141.4° F. |
| 30% | 159.4° F. |
| 40% | 182.3° F. |
| 50% | 207.6° F. |
| 60% | 230.9° F. |
| 70% | 251.2° F. |
| 80% | 277.5° F. |
| 90% | 320.3° F. |
| 95% | 347.1° F. |
| FBP | 417.2° F. |
| RECOVERY | 99.2 vol. % |

TABLE I-continued

| Typical Gasoline | |
|---|---|
| LOSS | 0.1 vol. % |
| RESIDUE | 0.7 vol. % |

These commercial gasolines typically contain components derived from catalytic cracking, reforming, isomerization, etc. Although the octane number of any gasoline may be improved by the technique of this invention, it is preferred to treat charge gasolines of nominal octane number between 75–95. The gasolines may contain other common additives for the improvement of detergency, emissions, dispersancy, corrosion resistance, anti-haze, etc.

It is a feature of the gasoline compositions of the present invention that they exhibit increased motor octane number (MON) and research octane number (RON). The experimental engine parameters that distinguish MON from RON are summarized in Table 2.

TABLE 2

| RON v. MON Experimental Conditions | RON Light Duty; Original CFR | MON Heavy Duty; New CFR |
|---|---|---|
| Engine speed, rpm | 600 | 900 |
| Intake air temperature, °F. | 125 | 100 |
| Mixture temperature, °F. | not controlled | 300 |
| Spark advance | for maximum power (later 13°) | automatic* |

*Changes automatically with compression ratio; basic setting is 26° before top center at 5:1 compression ratio.

A six component gasoline blend, shown in Table 3 was used to test the additives of the invention.

TABLE 3

| Experimental Gasoline Blend | |
|---|---|
| Compound | Amount (wt. %) |
| isopentane | 30 |
| n-heptane | 10 |
| i-octane | 5 |
| n-dodecane | 7 |
| toluene | 25 |
| i-butylbenzene | 10 |

EXAMPLE 1 and 2

In Examples 1 and 2, 2.0 wt. % of the additive of the present invention, wherein the dialkyl diphenylamine contains a Gaussian distribution of all possible isomers, permutations, and structural orientations of $C_4$–$C_8$ alkyl groups, was added to the experimental gasoline composition described above. In Example 1, five samples of the base fuel and the base fuel plus the additive of the present invention were tested for research octane number repeatability, using ASTM D2700. The results are presented in Table 4. Likewise, in Example 2, five samples of the base fuel and the base fuel plus the additive of the present invention were tested for motor octane number repeatability, using ASTM D2699. The results are presented in Tables 4 and 5

TABLE 4

| Example I Sample | Experimental Base Fuel RON | Experimental Base Fuel plus dialkyl diphenylamine mixture RON |
|---|---|---|
| 1 | 81.5 | 85.5 |
| 2 | 81.8 | 81.5 |
| 3 | 81.6 | 85.5 |
| 4 | 81.8 | 85.2 |
| 5 | 82.0 | 85.4 |
| Average | 81.7 | 85.4 |

TABLE 5

| Example 2 Sample | Experimental Base Fuel MON | Experimental Base Fuel plus dialkyl diphenylamine mixture MON |
|---|---|---|
| 1 | 72.7 | 75.8 |
| 2 | 73.1 | 75.4 |
| 3 | 73.3 | 75.6 |
| 4 | 73.5 | 75.5 |
| 5 | 73.3 | 75.8 |
| Average | 73.2.3 | 75.6 |

Thus, at a concentration of 2.0 wt. %, the additive of the present invention provides a significant average RON increase of 3.7 units and a significant average MON increase of 2.4 units. It provides this octane increase without recourse to metallic anti-knock additive agents.

EXAMPLES 3

Figure 2:
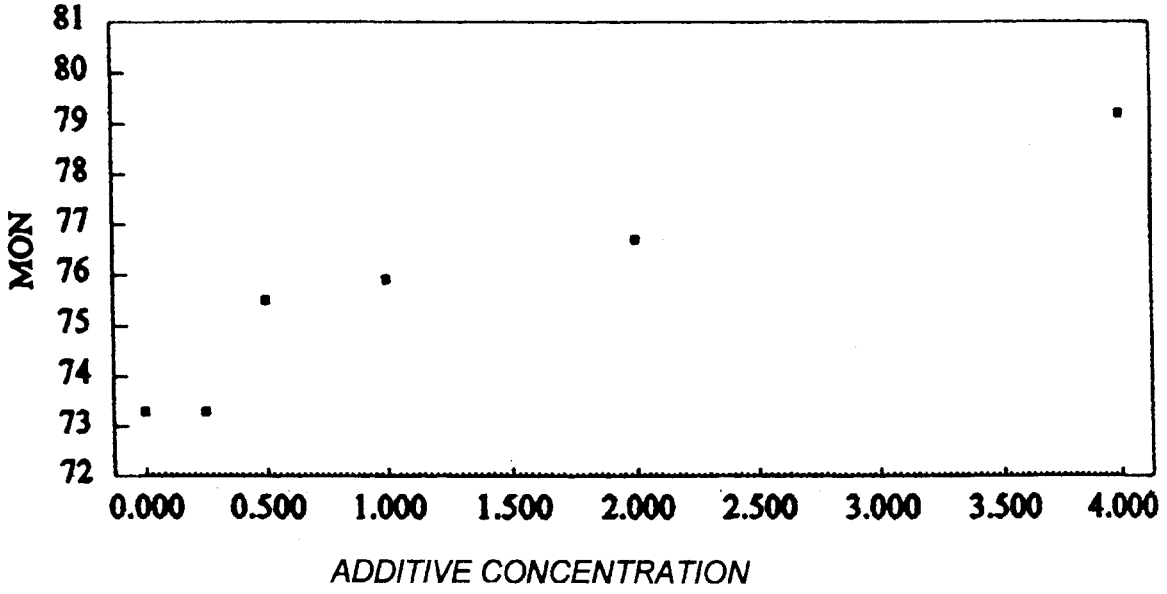

In this example, the same additive was tested in a concentration study to determine the additive concentration effects on octane number. The results are provided in Table 6; The results are also depicted FIG. 1 and 2. FIG. 1 is a graph which plots research octane number against additive concentration and FIG. 2 is a graph which plots motor octane number against additive concentration.

TABLE 6

| Additive Concentration Study | | |
|---|---|---|
| Wt. % Additive | MON* | RON* |
| 0.0 | 73.3 | 81.5 |

TABLE 6-continued

| Additive Concentration Study | | |
|---|---|---|
| Wt. % Additive | MON* | RON* |
| (Base Fuel) | | |
| 0.3 | 73.3 | 81.8 |
| 0.5 | 75.5 | 83.0 |
| 1.0 | 75.9 | 83.75 |
| 2.0 | 76.7 | 85.2 |
| 4.0 | 79.2 | 86.95 |

.*Average of two runs

The data indicate that significant octane increase is achieved with as little as 0.5 wt. % of the additive of the present invention.

We claim:

1. A lead free gasoline composition comprising a major portion of gasoline and about 0.5 to 2 wt % of a mixture of dialkyl diphenylamines represented by the formula:

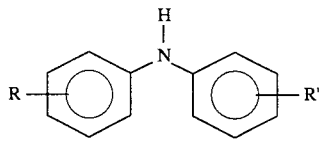

where R and R' independently comprise $C_4$ to $C_8$ alkyl radicals and wherein said mixture of dialkyl diphenylamines comprises said $C_4$ to $C_8$ alkyl radicals in Gaussian distribution of all isomers.

2. A method of improving the octane number of a lead free gasoline which comprises adding to a major portion of gasoline about 0.5 to 2 wt % of a mixture of dialkyl diphenylamines, represented by the formula:

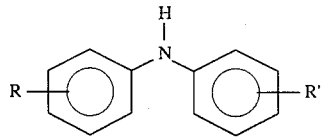

where R and R' independently comprise $C_4$ to $C_8$ alkyl radicals and wherein said mixture of dialkyl diphenylamines comprises said $C_4$ to $C_8$ alkyl radicals in Gaussian distribution of all isomers.

* * * * *